US006776576B2

(12) United States Patent
Lee

(10) Patent No.: US 6,776,576 B2
(45) Date of Patent: Aug. 17, 2004

(54) BLOWER FOR FORCING HOT AIR OUT OF A COMPUTER

(76) Inventor: Thomas Hokun Lee, 1933 S. Jodon Ct., Hacienda Heights, CA (US) 91745

( * ) Notice: Subject to any disclaimer, the term of this patent is extended or adjusted under 35 U.S.C. 154(b) by 0 days.

(21) Appl. No.: 10/103,468

(22) Filed: Mar. 20, 2002

(65) Prior Publication Data

US 2003/0180144 A1 Sep. 25, 2003

(51) Int. Cl.[7] ..... F04D 29/62

(52) U.S. Cl. ..... 415/206; 415/211.2; 415/214.1; 415/213.1

(58) Field of Search ..... 415/175, 206, 415/214.1, 211.2, 213.1; 361/697

(56) References Cited

U.S. PATENT DOCUMENTS

| | | | | |
|---|---|---|---|---|
| 3,597,117 A | * | 8/1971 | Zoehfeld | 417/354 |
| 4,128,364 A | * | 12/1978 | Papst et al. | 417/354 |
| 6,362,958 B1 | * | 3/2002 | Yu et al. | 361/687 |
| 6,411,511 B1 | * | 6/2002 | Chen | 361/697 |

* cited by examiner

*Primary Examiner*—Ninh H. Nguyen
(74) *Attorney, Agent, or Firm*—David A. Belasco; Belasco Jacobs & Townsley, LLP

(57) ABSTRACT

A blower for forcing hot air out of a computer is disclosed. The blower includes a hollow body having an air inlet and an air outlet, with a turbofan arranged in the hollow body to cause hot air to flow from the air inlet to the air outlet. Additionally, a mounting piece is provided for installing the hollow body in place in the computer.

8 Claims, 5 Drawing Sheets

BLOWER FOR FORCING HOT AIR OUT OF A COMPUTER

BACKGROUND OF THE INVENTION

1. Field of the Invention

The present invention relates to a blower for a computer and, more particularly, to a blower which forces hot air out of a computer.

2. Description of Related Art

It is well known that important components of a computer, i.e. the CPU (central processing unit), the DRAM (dynamic random access memory) and the hard disk, are operated at a much higher rate than ever, generating a large amount of heat that must be removed.

Although there have been various heat dissipaters in the prior art for such removal, they can only blow away hot air immediately around the components. The average temperature in the computer then rises, possibly creating an environment improper to the operation of the computer.

Therefore, it is an objective of the invention to provide a blower for forcing hot air out of a computer to mitigate and/or obviate the aforementioned problem.

SUMMARY OF THE INVENTION

The object of the present invention is to provide a blower which forces hot air out of a computer.

Other objects, advantages and novel features of the invention will become more apparent from the following detailed description when taken in conjunction with the accompanying drawings.

DETAILED DESCRIPTION OF THE PREFERRED EMBODIMENT

Figure 1:
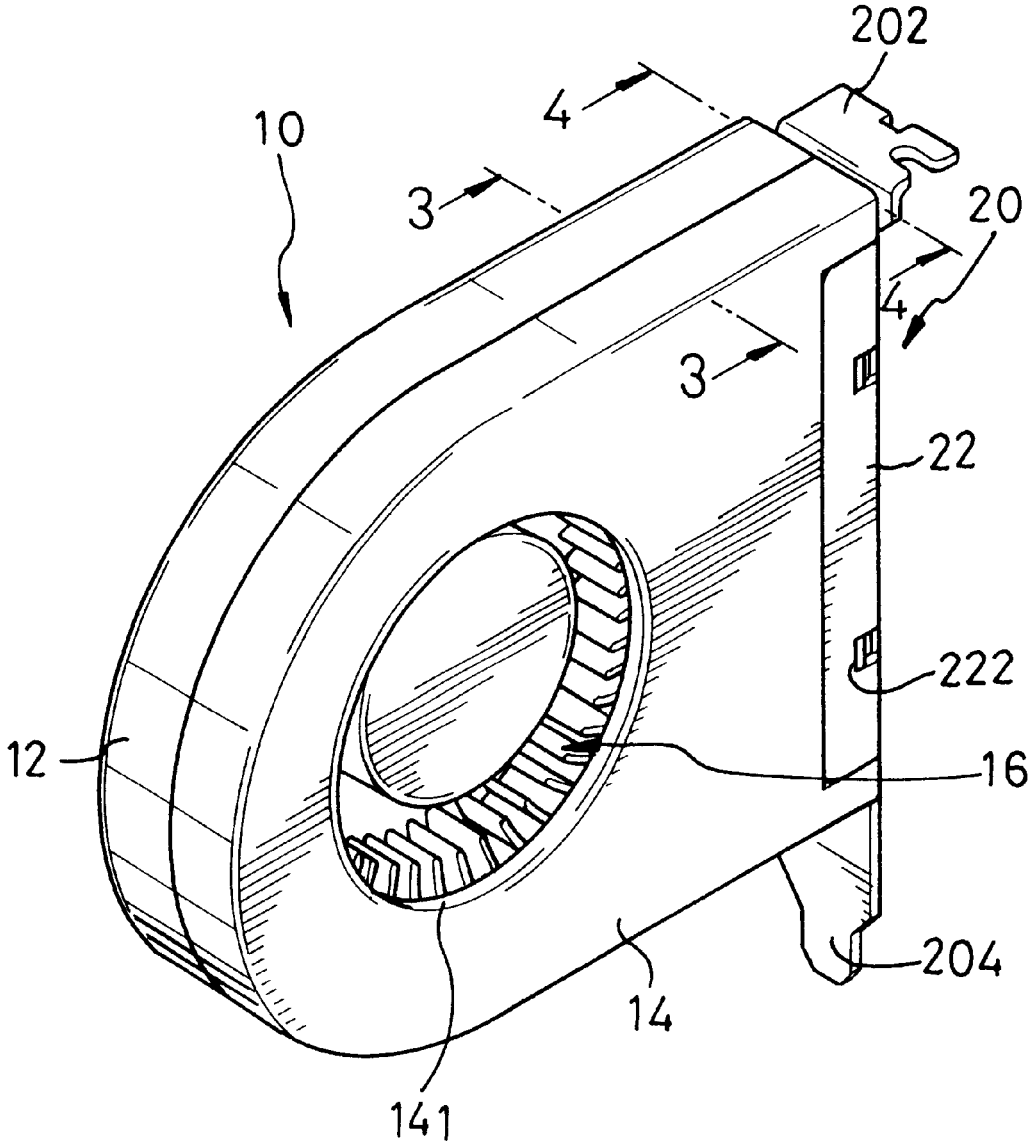
FIG. 1 is a perspective view of a preferred embodiment of a blower in accordance with the present invention for forcing hot air out of a computer.

Referring to FIG. 1, there is shown a preferred embodiment of a blower in accordance with the present invention for forcing hot air out of a computer. The blower includes a hollow body (10) having an air inlet (141), with a turbofan (16) arranged in the hollow body (10) in a place aligned with the air inlet (141).

The hollow body (10) has a curved end and a mounting piece (20), opposed to the curved end, is attached to the hollow body (10) for installing the body (10) in place in the computer.

Figure 2:
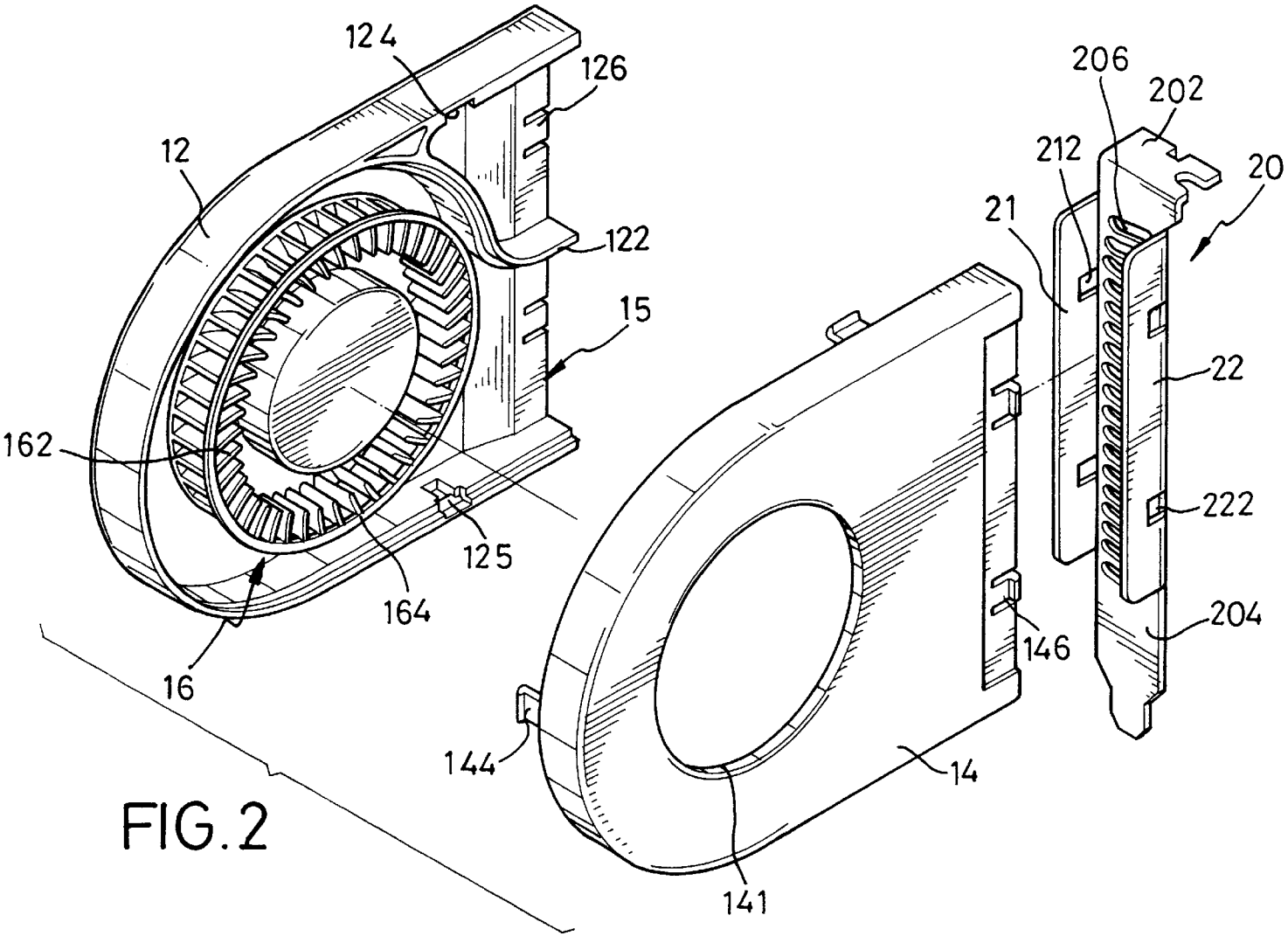
FIG. 2 is an exploded perspective view of the blower shown in FIG. 1.

Referring to FIG. 2, the hollow body (10) includes a front cover (12) and a rear cover (14), with the front cover (12) formed with the air inlet (141). The covers (12,14) are configured so that the hollow body (10) has an open end serving as an air outlet (15), which, in the highly preferred embodiment, is also opposed to the curved end. In other words, the mounting piece (20) is attached to the hollow body (10) at this open end.

Figure 5:
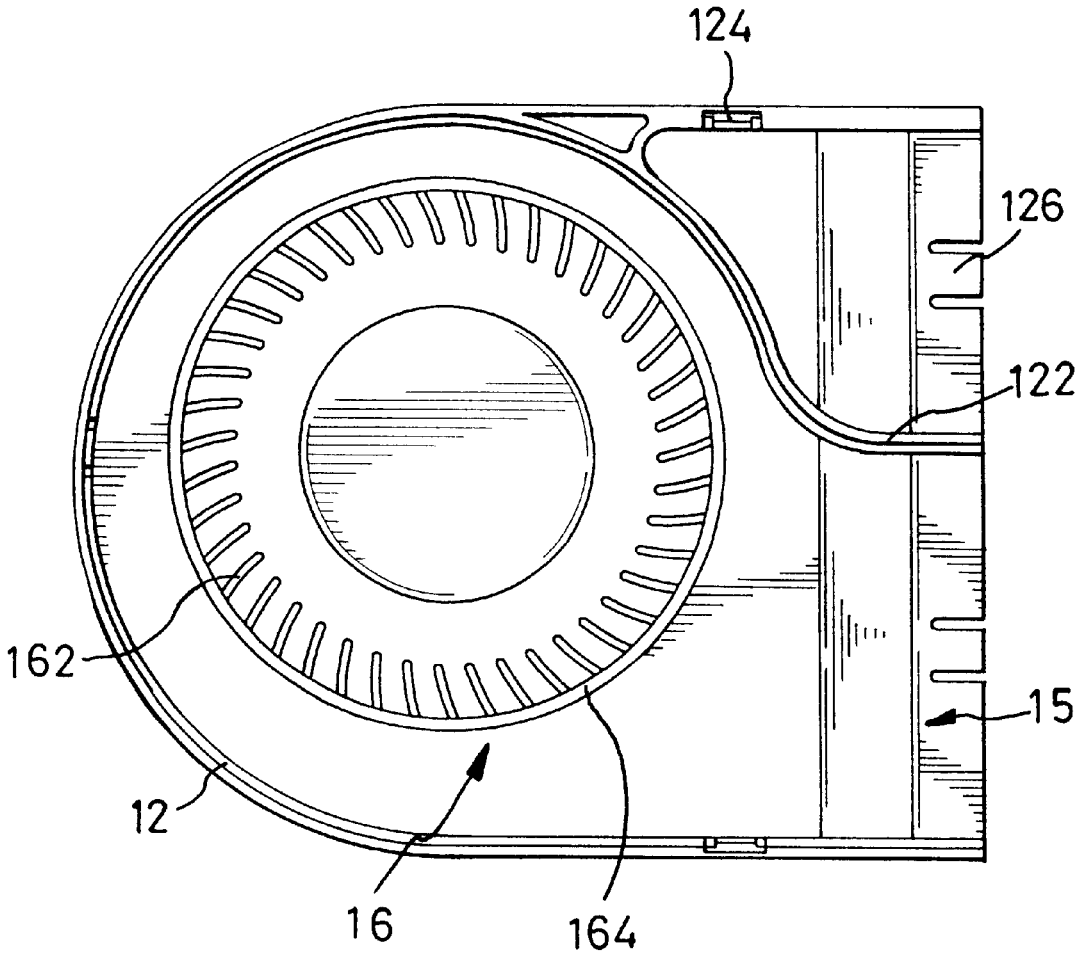
FIG. 5 is a front view of the blower of FIG. 1, with a front cover removed.

The turbofan (16) has a plurality of blades (162) interconnected and reinforced, such as by a common ring (164). With the turbofan (16) being rotated, air is forced to flow from the air inlet (141) to the air outlet (15), following the lead of baffles (122, 142) formed in the covers (12,14), as best seen in FIG. 5.

Figure 3:
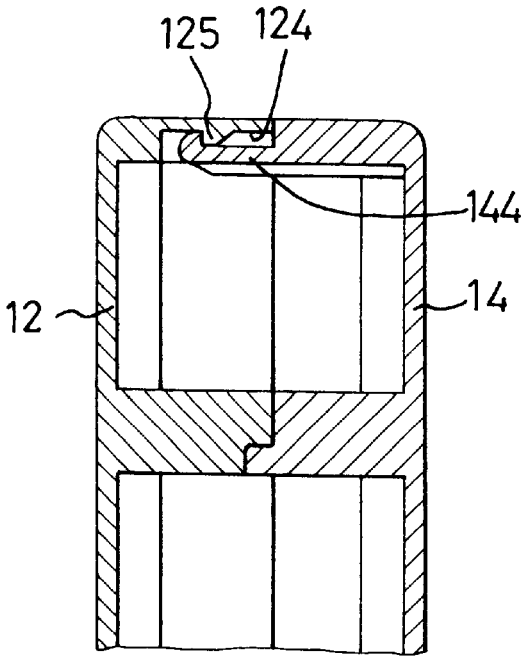
FIG. 3 is a fragmentary cross-sectional view of the blower shown in FIG. 1.

Referring to FIGS. 2 and 3, the covers (12,14) can be connected in many ways. For example, the rear cover (12) may have a plurality of recesses (124) formed with respective barbs (125), while the front cover (14) may have a plurality of hooked tabs (144) extending into the recesses (124) and engaged with the barbs (125), thereby connecting covers (12,14) to each other.

Figure 4:
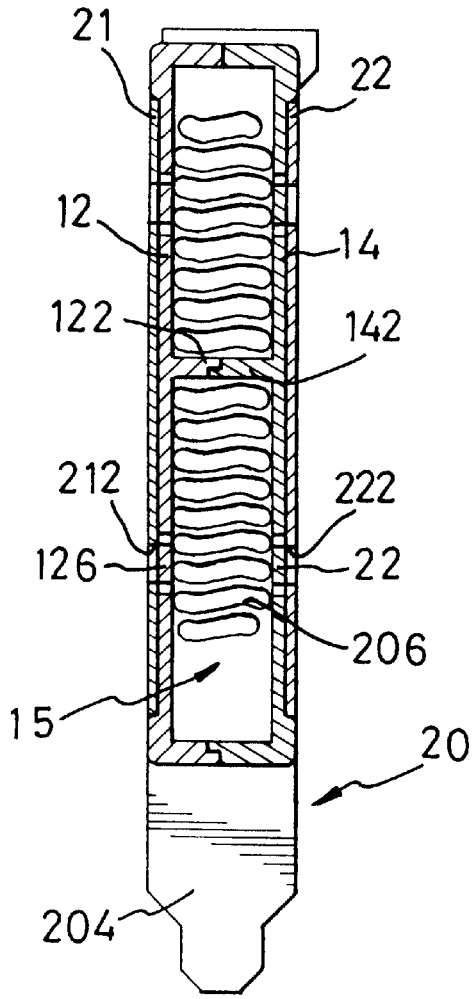
FIG. 4 is another fragmentary cross-sectional view of the blower shown in FIG. 1.

Referring to FIGS. 2 and 4, the mounting piece (20) is attached to the hollow body (10) at its open end or air outlet (15), as mentioned above. The mounting piece (20) includes a vertical line of vents (206) in alignment with the air outlet (15), a top portion (202) extending therefrom in a direction away from the hollow body (10), and a tail (204) extending therefrom below the hollow body (10).

The mounting piece (20) further has a pair of substantially parallel wings (21,22) connected to the covers (12,14). In the illustrated embodiment, the wings (21, 22) are formed with a plurality of orifices (212,222), and the covers (12,14) are formed with a plurality of hooks (126,146) snapping into the orifices (212,222), and hence connecting the mounting piece (20) to the covers (12,14).

Figure 6:
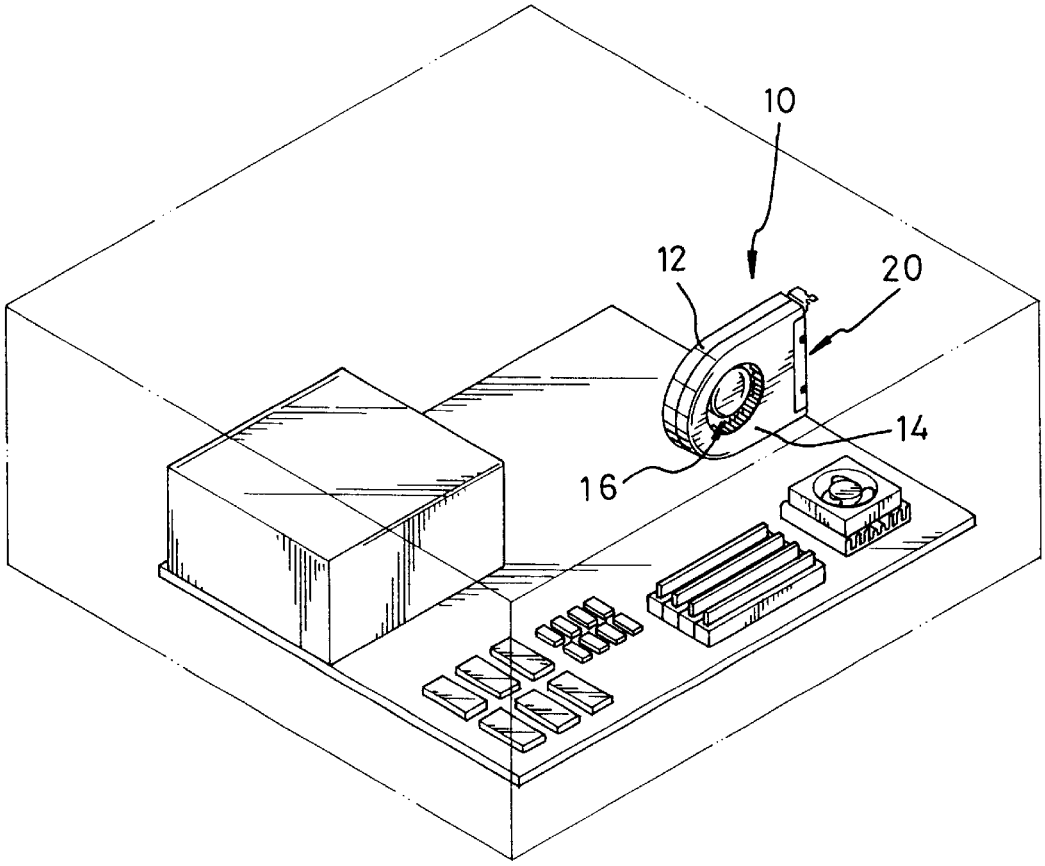
FIG. 6 is a schematic view showing the blower of FIG. 1 installed in place in a computer.

Referring to FIG. 6, the inventive blower is to be installed in the computer in a space reserved for accessory boards, e.g. a coax adapter board or an audio board.

To this end, a slot cover must be unscrewed and removed from the back panel of the computer, and the mounting piece (20) must be slid into the board guide of the chosen slot, with the tail (204) placed in a slit between the main board and the back panel, and with the top portion (202) resting on and screwed to a shelf on the back panel.

If then the turbofan is switched on, hot air can surely be blown from the interior to the exterior of the computer, creating an environment for the proper operation of any important component within the computer, especially the CPU.

From the above description, it is noted that the invention has the advantage of forcing hot air out of the computer.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A blower for forcing hot air out of a computer, comprising:

a hollow body (10) having an air inlet (141) and an air outlet (15);

a turbofan (16) arranged in said hollow body (10) to cause hot air to flow from said air inlet (141) to said air outlet (15);

said hollow body (10) including a front cover (12) and a rear cover (14) connected to each other, said front cover (12) being formed with said air inlet (141) in a place aligned with said turbofan (16);

one of said covers (12,14) having a plurality of recesses (124) formed with respective barbs (125), and the other of said covers (12,14) having a plurality of hooked tabs (144) extending into said recesses (124) and engaged with said barbs (125), thereby connecting said covers (12,14) to each other; and a mounting piece (20) for installing said hollow body (10) in place in said computer.

2. The blower as claimed in claim 1, wherein said covers (12,14) are formed with respective baffles (122,142) for leading hot air from said air inlet (141) to said air outlet (15).

3. The blower as claimed in claim 1, wherein said mounting piece (20) has a pair of substantially parallel wings (21,22) connected to said covers (12,14).

4. The blower as claimed in claim 3, wherein said wings (21, 22) have a plurality of orifices (212,222) defined therein, and wherein said covers (12,14) have a plurality of hooks (126,146) snapping into said orifices (212,222), thereby connecting said mounting piece (20) to said covers (12,14).

5. The blower as claimed in claim 3, wherein said mounting piece (20) further includes a top portion (202) extending therefrom in a direction away from said hollow body (10), and a tail (204) extending therefrom below said hollow body (10).

6. The blower as claimed in claim 1, wherein said hollow body (10) has a curved end and an open end opposed to said curved end, and wherein said open end serves as said air outlet (15).

7. The blower as claimed in claim 6, wherein said mounting piece (20) is attached to said hollow body (10) at said open end.

8. The blower as claimed in claim 7, wherein said mounting piece (20) has a plurality of vents (206) in alignment with said air outlet (15).

* * * * *